US005504397A

United States Patent [19]

Chien

[11] Patent Number: 5,504,397

[45] Date of Patent: Apr. 2, 1996

[54] NEON LAMP ASSEMBLY

[76] Inventor: Tseng-Lu Chien, 8Fl.-6, No. 9, San Min Rd., Taipei, Taiwan

[21] Appl. No.: 300,051

[22] Filed: Sep. 2, 1994

[51] Int. Cl.[6] ..... H05B 37/00

[52] U.S. Cl. ..... 315/185; 315/129; 248/51; 362/217

[58] Field of Search ..... 315/129, 185 S; 40/545; 248/50, 51; 362/217; 313/567, 318

[56] References Cited

U.S. PATENT DOCUMENTS 5,036,447 7/1991 Taylor ..... 248/51

5,286,217 2/1994 Volz ..... 362/217

5,303,127 4/1994 Kosann ..... 362/217

*Primary Examiner*—Frank Gonzalez

*Assistant Examiner*—Reginald A. Ratliff

*Attorney, Agent, or Firm*—William E. Pelton

[57] ABSTRACT

A neon lamp assembly includes a neon lamp, a frequency/voltage conversion circuit board for powering the neon lamp, a housing for receiving the neon lamp and the circuit board, a cable for supplying a DC power for the circuit board, a plurality of pins provided between the cable and the circuit board for penetrating the sheaths of the cable and receiving power from the cable.

5 Claims, 3 Drawing Sheets

NEON LAMP ASSEMBLY

BACKGROUND OF THE INVENTION

The present invention relates to a neon lamp, and particularly to a connection structure for use in neon lamps.

Neon lamps are useful indicating devices for various occasions and locations. The neon lamps may be twisted into various patterns and letters such as a Christmas tree, a star or a name etc. They have also been widely used in many public locations such as restaurants, disco centers, bars etc.

A neon lamp is powered by an electricity supply of 220 voltage by means of a transformer having a voltage of 6 KV–15 KV at its secondary side. Thus, the risk of electric shock is increased. Further, as one transformer may only be used in one neon lamp, the resulting effect is simple without variability.

SUMMARY OF THE INVENTION

An object of the present invention is to provide a neon lamp assembly which prevents the users from receiving an electric shock.

Another object of the present invention is to provide a neon lamp assembly which is easy to be installed.

A further object of the present invention is to provide a neon lamp assembly which may be compatible with light fixtures which use a direct current (DC) voltage.

A further object of the present invention is to provide a neon lamp which is suitable to be installed at a location separate from a building such as a car or a garden.

A further object of the present invention is to provide a neon lamp assembly which may sequentially control the on/off of the neon lamps and produce a variable accent.

According to the present invention, a neon lamp assembly includes a DC power cord for supplying a DC power to the whole assembly, a neon lamp, a frequency/voltage conversion circuit for generating a high voltage to turn on the neon lamp, two metal lead-out pins for connecting the DC power cord with the frequency/voltage conversion circuit, and a housing for receiving the neon lamp, and the conversion circuit.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
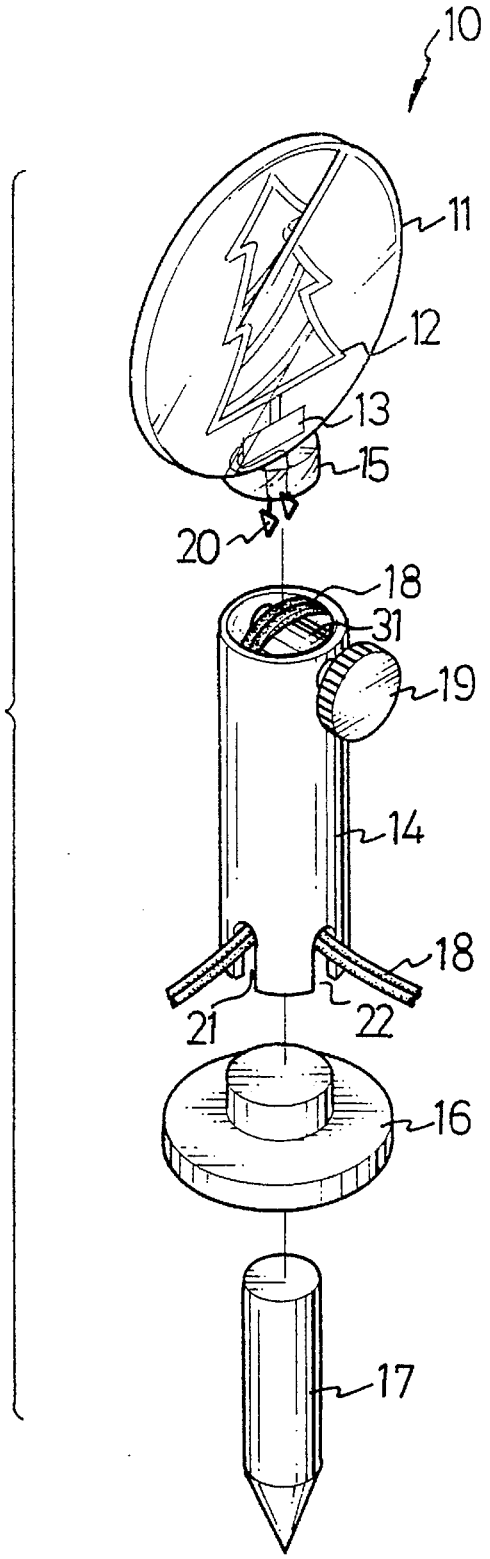
FIG. 1 is a perspective exploded view of the neon lamp assembly of the present invention.

Referring to FIG. 1, there is shown a perspective exploded view of a neon lamp assembly 10 in accordance with the present invention. As shown in the drawing, the neon lamp assembly 10 has a housing 11 sized to receive a neon lamp 12 and a frequency/voltage conversion circuit board 13, a support tube 14 for receiving a protruded portion 15 of the housing 11, and a pedestal 16 for receiving the tube 14. The neon lamp assembly 10 is further secured onto a ground surface by a stake 17. A cable 18 having two conductive wires is provided within the support tube 14 for electrically connecting to the conversion circuit board 13 which has two pins 20 for passing through sheaths of the cable 18 and achieving electrical connection therebetween. The support tube 14 has two notches 21, 22 on a wall thereof for the cable 18 to pass through. A knob 19 is engaged with a ratchet wheel (not shown) within the tube 14 for pushing the cable 18 onto the pins 20.

Figure 2:
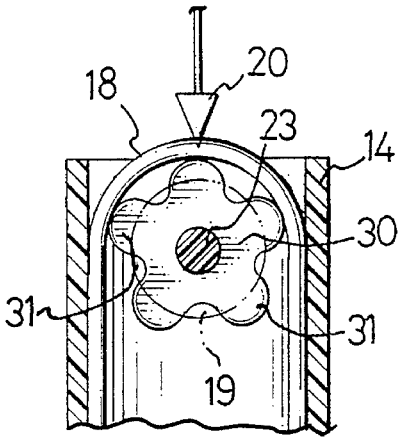
FIG. 2 is a partially cross-sectional view showing a connection structure of the neon lamp assembly of FIG. 1.

As shown in FIG. 2, the connection structure inside the support tube 14 is shown in a cross-sectional view. The knob 19 shown by dashed lines is engaged with a ratchet wheel 30 by a shaft 23. The ratchet wheel 30 has five teeth 31 for pushing the cable 18 onto the pins 20. When the user turns the knob 19 and one of the teeth is under the pins 20, the cable 18 is pushed onto the pins 20 such that the tips of the pins 20 may pass through the sheaths of the cable 18 and be in electrical contact with the conductor of the cable 18. When the user further turns the knob 19 it no longer urges the cable 18 against the pins 20, thus the neon lamp will be disconnected from the power supply.

Figure 3:
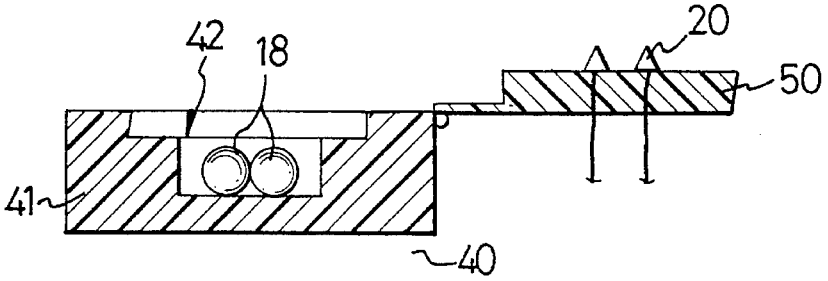
FIG. 3 is a cross-sectional view of another embodiment of the connection structure of the neon lamp assembly in accordance with this invention.

FIG. 3 shows a clamp 40 having a base 41 and a cover 50 pivotally attached thereto. The base has a bottom surface, two walls, a longitudinal slot with a groove centrally defined in the slot. The cover 50 has a top surface, a bottom surface, a first sidewall and a second sidewall. A hinge plate extends from the first sidewall to link pivotally the cover with base. The cover is sized so that the bottom surface will be received in the cover 50. Two electrically conductive spikes are securely attached to the bottom surface of the cover, each aligning with one of the holes. A wire extends from each of the spikes through each hole and continues to the conversion circuit board 13. Two wires carrying an electric current are fittingly received in the groove. The cover can be swung towards the base so that the bottom surface is disposed in the slot and each spike penetrates a sheath of one of the wires carrying an electric current.

To disconnect the power supply from the neon lamp, a user exert a force against the bottom surface of the base thereby slightly deforming the clamp so that the snapping lock of the base is overcome and the cover exits the slot thereby breaking contact between the spikes and the current carrying wires. A feature of this clamp is that the second sidewall of the cover has a lip protruding therefrom so that when the cover is pressed into the slot, the lip provides a snapping lock.

Figure 4:
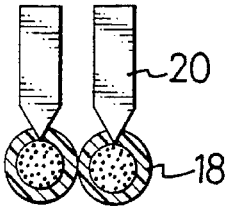
FIG. 4 is a cross-sectional view of a further embodiment of the connection structure of the neon lamp assembly in accordance with this invention.

FIG. 4 is perspective view of the connection structure of the neon lamp assembly. The pins 20 pass through the sheaths of the cable 18 and are in connection with the conductors of the cable 18.

Figure 5:
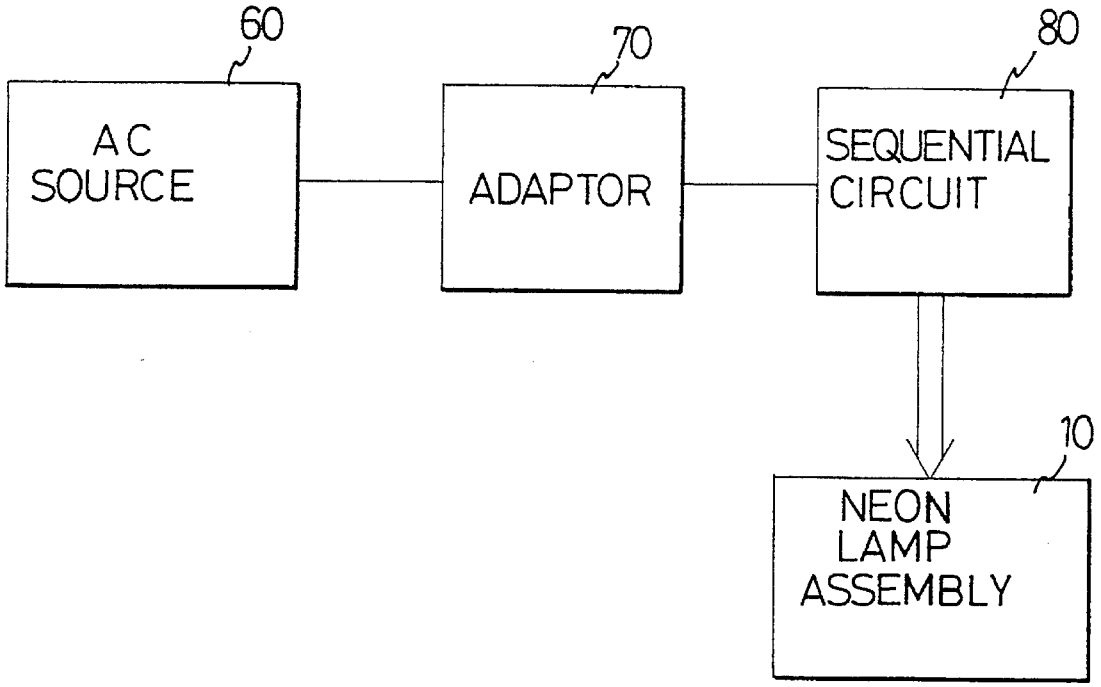
FIG. 5 is a block diagram showing the interconnection between an AC power source and this invention.

Referring to FIG. 5, an indoor AC source 60 is used to provide the power needed by the whole system. An AC/DC adaptor 70 is connected to the AC source 60 for converting the AC power into a DC voltage for example 12 volts which may be applied to the location of garden with a cable 18 (in FIG. 1) without the risk of electric shock. A sequential circuit 80 is connected between the AC/DC adaptor 70 and a neon lamp assembly 10 for sequentially turning on the neon lamp thereby achieving an "alternating" image.

Although the invention has been explained in relation to its preferred embodiment, it is to be understood that many other possible modifications and variations can be made without departing from the spirit and scope of the invention as hereinafter claimed.

I claim:

1. A neon lamp assembly comprising:

a neon lamp;

a frequency/voltage conversion circuit board connected to the neon lamp with a plurality of metal pins for receiving a power source;

a cable for carrying a direct current power to the conversion circuit board;

a housing, sized to receive the neon lamp and the frequency/voltage conversion circuit board; and a supporting device having a ratchet wheel engaged by a knob for pushing the cable onto the pins of the conversion circuit so that tips of the pins pass through sheaths of the cable and are in electrical contact with the power source.

2. A neon lamp assembly according to claim 1 further comprising:

a pedestal for engaging with the supporting device; and a stake for securing the pedestal onto a ground.

3. A neon lamp assembly according to claim 1 wherein said supporting device is tubular shape.

4. A neon lamp assembly according to claim 1 wherein said direct current power is derived from an indoor alternating current power source by means of an AC/DC adaptor.

5. A neon lamp assembly comprising:

a neon lamp;

a frequency/voltage conversion circuit board connected to the neon lamp a clamp having a longitudinal slot base and a plurality of metal pins connected to the conversion circuit board and secured to a surface of a cover faced to the base;

a cable passing through the longitudinal slot base and carrying direct current power to the conversion circuit board; and a housing, sized to receive the neon lamp and the frequency/voltage conversion circuit board.

* * * * *